US005520306A

United States Patent [19]

Umiker

[11] Patent Number: 5,520,306

[45] Date of Patent: May 28, 1996

[54] RECEPTACLE MADE OF PLASTIC MATERIAL AND HAVING HOOP HANDLE CONNECTED BY INTEGRAL HINGES

[75] Inventor: Hans Umiker, Egg, Switzerland

[73] Assignee: Schoeller-Plast SA, Romont, Switzerland

[21] Appl. No.: 221,964

[22] Filed: Apr. 4, 1994

[30] Foreign Application Priority Data

Apr. 8, 1993 [CH] Switzerland ..... 1075/93

[51] Int. Cl.[6] ..... B65D 23/10

[52] U.S. Cl. ..... 220/754; 220/771

[58] Field of Search ..... 220/754, 771, 220/657, 659

[56] References Cited

U.S. PATENT DOCUMENTS

| | | | |
|---|---|---|---|
| 1,682,048 | 8/1928 | Levien | 220/754 |
| 3,620,410 | 11/1971 | Griese, Jr. | 220/754 |
| 3,737,069 | 6/1973 | Owen | 220/754 |
| 4,399,926 | 8/1983 | Eidels-Dubovoy | 220/754 |
| 4,446,986 | 5/1984 | Bowen et al. | 220/754 |
| 4,989,744 | 2/1991 | Tominaga . | |
| 5,027,973 | 7/1991 | Drogos | 220/657 |
| 5,215,210 | 6/1993 | Ostrum et al. | 220/754 |

FOREIGN PATENT DOCUMENTS

| | | | |
|---|---|---|---|
| 898276 | 3/1984 | Belgium . | |
| 0142870 | 5/1985 | European Pat. Off. . | |
| 2291103 | 6/1976 | France . | |
| 8523336 | 10/1985 | Germany . | |
| 3712405 | 10/1988 | Germany | 220/754 |
| 0586630 | 11/1974 | Switzerland . | |
| 2251431 | 7/1992 | United Kingdom . | |

OTHER PUBLICATIONS

WO,A,9 011 229—Oct. 4, 1990.
WO,A,8 707 578—Dec. 17, 1987.

*Primary Examiner*—Joseph M. Moy
*Attorney, Agent, or Firm*—Cushman Darby & Cushman

[57] ABSTRACT

A plastic receptacle has a pivotable hoop-handle, which, at two diametrically opposing carrying extensions is connected to the receptacle by strap hinges. Each of the carrying extensions is configured as a U-shaped, outwardly protruding stay, having two vertical bars connected by a bow, to the horizontal part of which bow the strap hinge, which is configured as a band-like, flexible intermediate piece, attaches tangentially at the bottom. When the hoop-handle is tilted up, the strap hinge bears against the outer side of the bow and of the adjoining bar. At a slight distance from the latter there is disposed a retaining cam, which projects like a ramp and retains the strap hinge, and therefore the hoop handle, in an approximately upright position. The receptacle includes a bucket, which is surrounded beneath the upper rim of its side wall by a reinforcing ring, injection-moulded in one piece from plastic, which is snapped removably onto the bucket and onto which the hoop handle is formed. The bucket and the reinforcing ring can be made of different materials from one another. The bucket can be provided with a plastics-film outer casing or inner casing, which reaches between the outer side of the side wall and the reinforcing ring and is clamped between the two. Similarly, a casing which surrounds the bucket externally and internally can be secured in place.

22 Claims, 8 Drawing Sheets

RECEPTACLE MADE OF PLASTIC MATERIAL AND HAVING HOOP HANDLE CONNECTED BY INTEGRAL HINGES

BACKGROUND OF THE INVENTION

The invention relates to a receptacle of a type which is used for the transportation and storage of liquids, pastes, granulates etc., e.g. paints, building materials or foodstuffs.

From U.S. Pat. No. 4,989,744, a receptacle of this type is known, in which a formed-on, pivotable hoop-handle is connected to carrying extensions which protrude outwards at two mutually opposing points of the upper rim on the outer side of the side wall. In order to ensure a connection which guarantees the pivotability of the hoop-handle, the latter is connected to the carrying extensions by film hinges, i.e. weak points, which can be very severely buckled depending upon the position of the hoop-handle. As a result of the severe buckling and the frequent change of position, film hinges generally suffer rapid fatigue, especially where, as in the case presently depicted, they are repeatedly subjected to relatively high tensile stresses whenever the receptacle is carried.

SUMMARY OF THE INVENTION

The invention is here intended to provide a remedy. The invention provides a receptacle having a pivotable, formed-on hoop-handle, in which severe bucklings are prevented and the material stress is thereby substantially reduced. Moreover, the configuration, according to the invention, of the receptacle allows the hinges to be more strongly fitted, so that they are substantially more resistant, especially to tensile stress, thereby enabling also larger loads to be borne in the receptacle.

BRIEF DESCRIPTION OF THE DRAWINGS

The invention is explained in greater detail below with reference to figures representing merely embodiments, in which.

DETAILED DESCRIPTION

Figure 1:
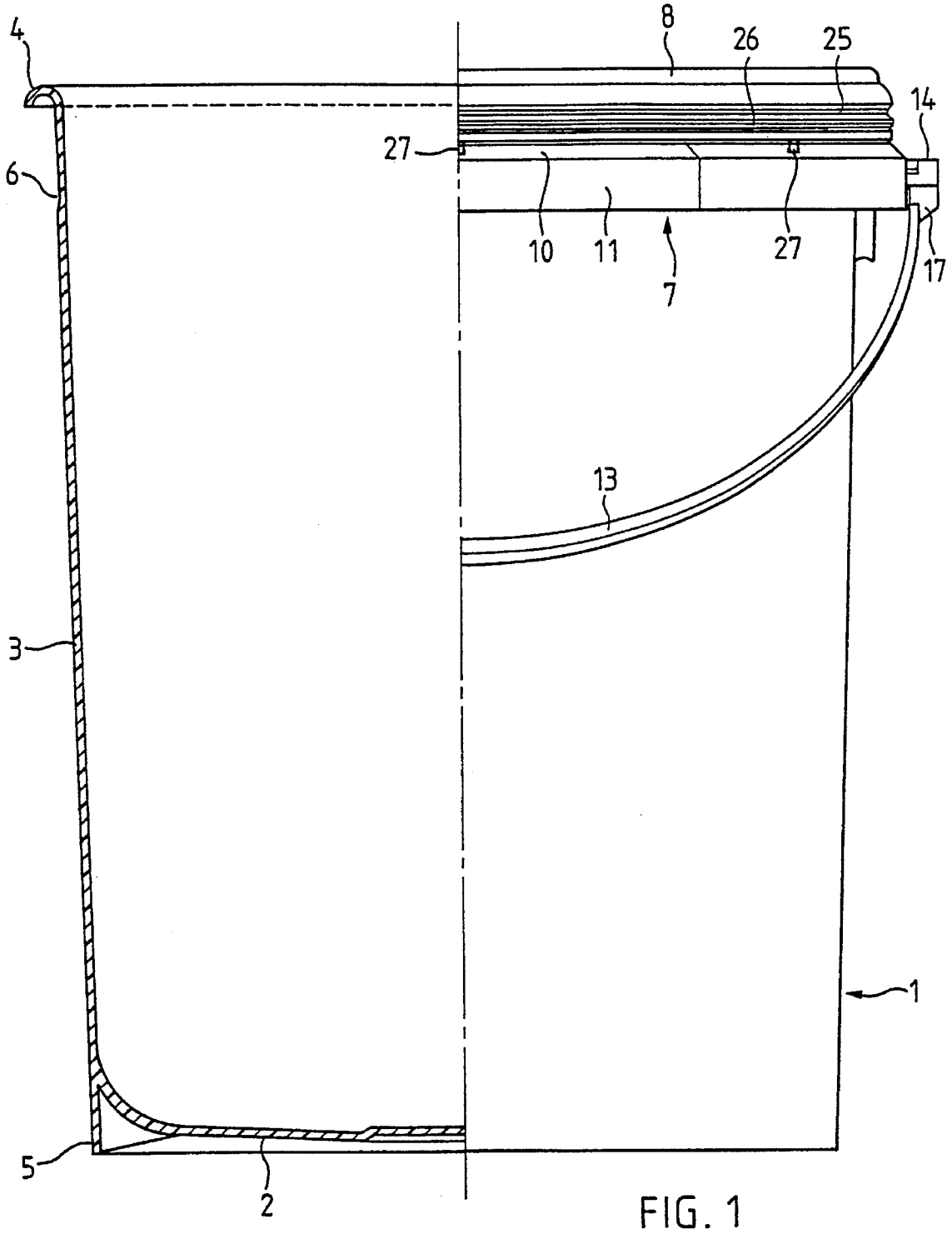
FIG. 1 shows, on the right, a side view of a receptacle according to the invention, exhibiting a hoop-handle, which is formed onto a reinforcing ring according to a first embodiment, and a lid, and, on the left, a vertical section through the vessel only.

FIG. 1 shows a receptacle comprising a plastics vessel, which is configured as a bucket 1 having a round base 2 and a circumferential side wall 3 with a slightly outward leaning inclination, which exhibits at its upper rim an outwardly pointing, convex lip 4 and terminates at the lower end in a marginal rib 5 surrounding the base 2. Somewhat beneath the upper rim, the side wall 3 is provided on the outer side with a circumferential, flat indentation 6 and bears a removable, circumferential reinforcing ring 7, according to a first embodiment, and a lid 8.

Figure 5:
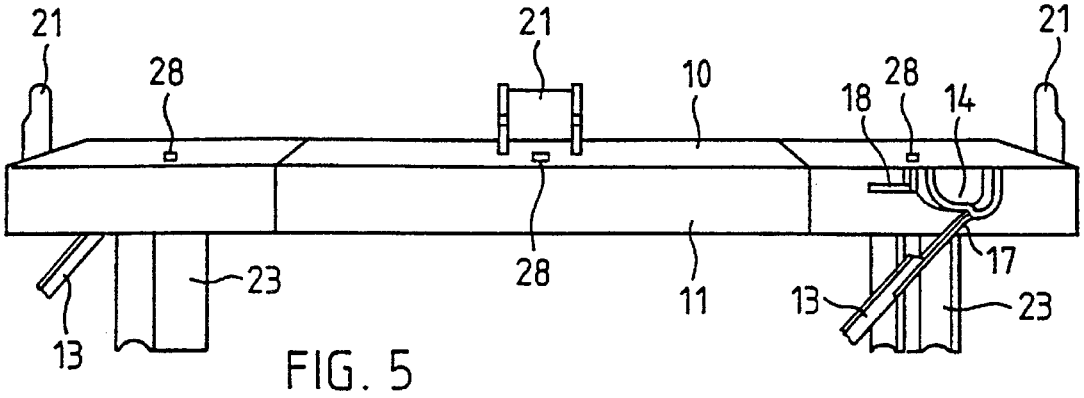
FIG. 5 shows a side view of the reinforcing ring according to the first embodiment.
Figure 6:
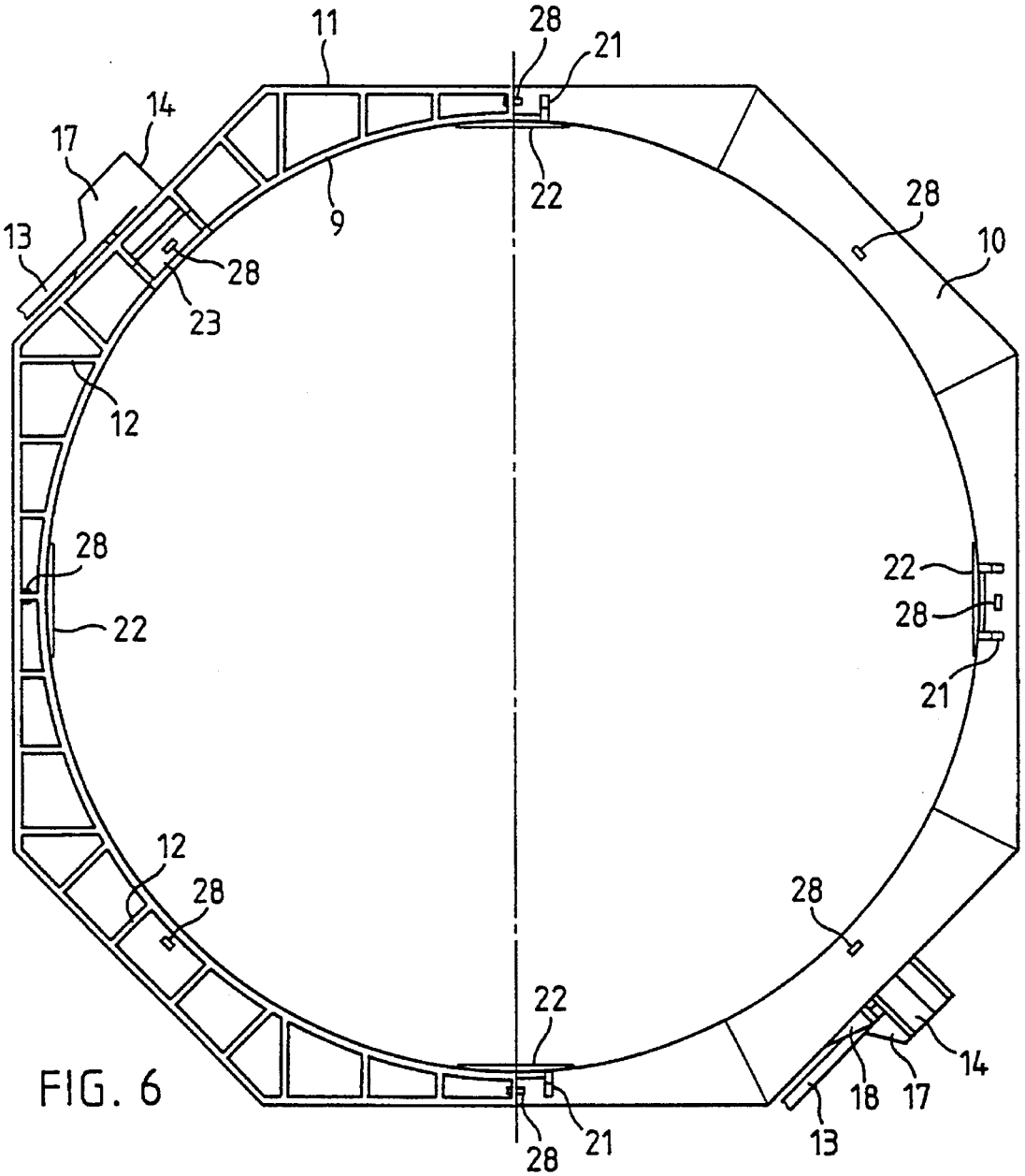
FIG. 6 shows a projection onto the reinforcing ring according to the first embodiment, on the left from below, on the right from above.
Figure 7:
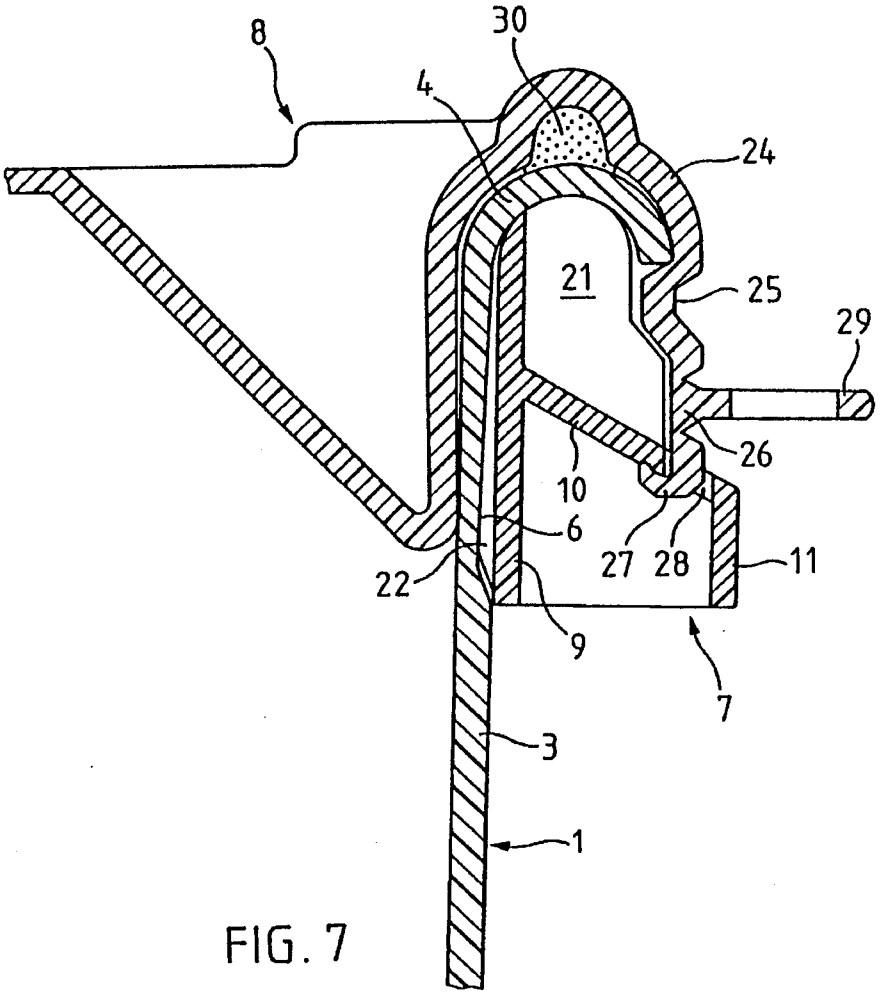
FIG. 7 shows a section through the upper rim of the side wall of the receptacle, exhibiting the reinforcing ring according to the first embodiment and the lid.

The reinforcing ring 7, which is injection-moulded in one piece from plastic, comprises (FIGS. 5–7) an annularly circumferential collar 9, which widens slightly in the upward direction and bears against the outer face of the side wall 3. It bears an outwardly protruding, octagonal stabilizing ring 10, which points obliquely downwards and the outer rim of which is adjoined by a downwardly pointing apron 11. For reinforcement purposes, a plurality of stabilizing ribs 12 connecting the collar 9 to the apron 11 are formed onto the underside of the stabilizing ring 10.

Figure 2:
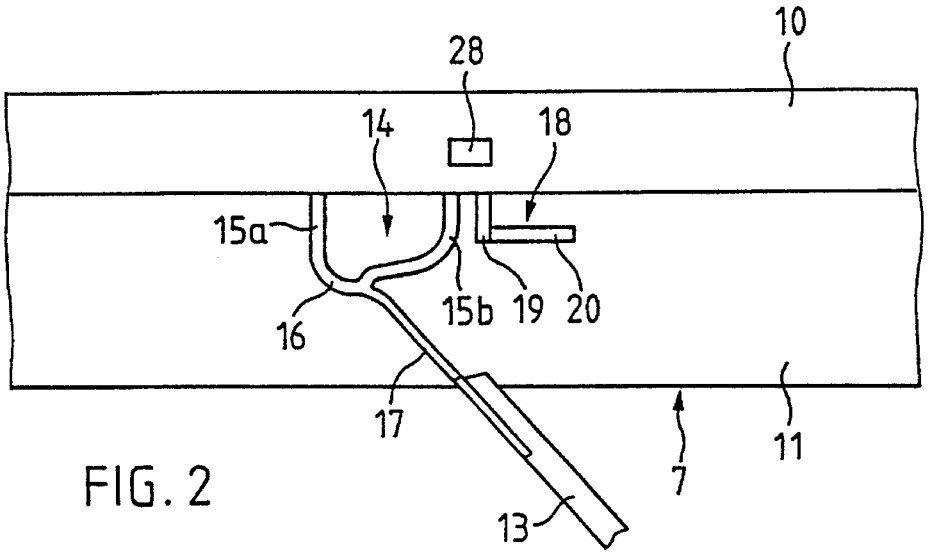
FIG. 2 shows an enlarged side view of a detail of the reinforcing ring according to FIG. 1, exhibiting a formed-on hoop-handle.
Figure 3:
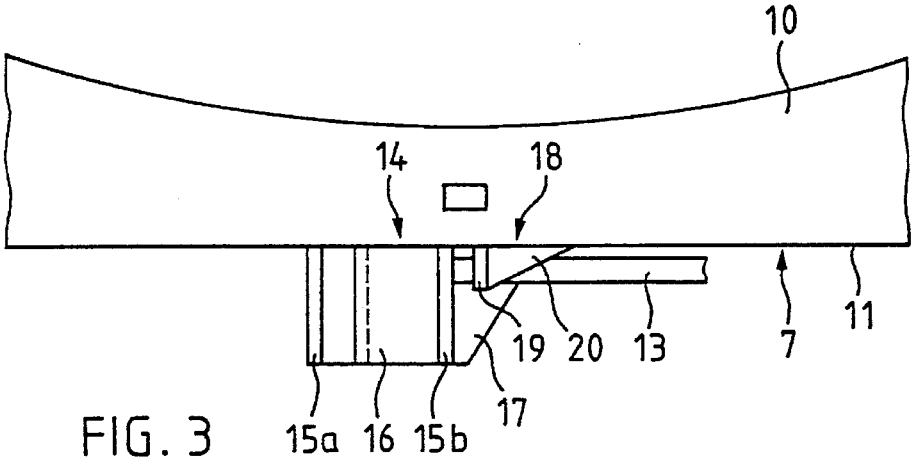
FIG. 3 shows the detail according to FIG. 2 in top view.
Figure 4:
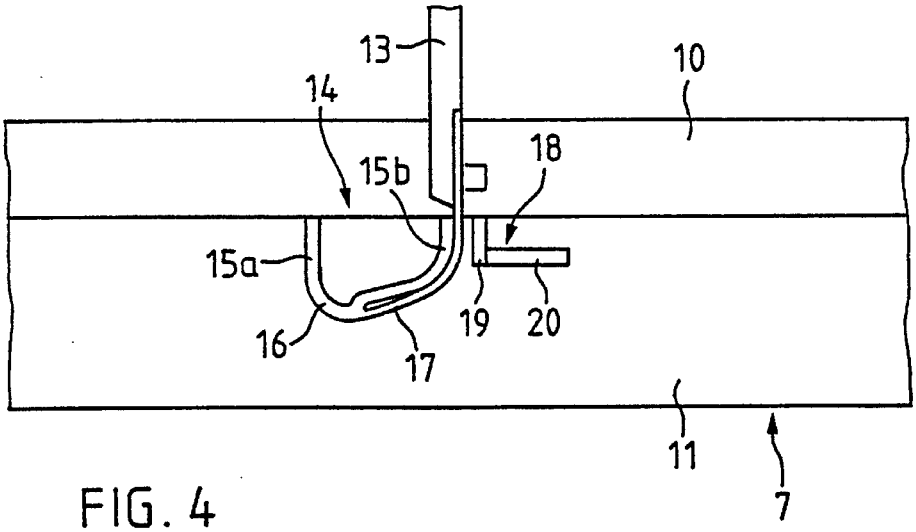
FIG. 4 shows a view according to FIG. 2, exhibiting the hoop-handle in the upright position.

The apron 11 bears a formed-on, pivotable hoop-handle 13 and is provided for this purpose, at two diametrically opposing points, with carrying extensions 14, which protrude outwards. These are configured (FIGS. 2–4) as U-shaped stays having a first vertical bar 15*a* and a second vertical bar 15*b*, which are connected by a bow 16. The hoop-handle 13 ends on both sides respectively in a strap hinge 17, which attaches to the horizontal part of the bow 16 and is directed, at the attachment point, likewise horizontally, i.e. tangentially to the carrying extension 14. The said strap hinge is configured as a relatively thin band of approximately the same width as the carrying extension 14. The line along which the strap hinge 17 separates from the carrying extension 14 runs radially and horizontally, i.e. parallel to the swivel axis running through the carrying extensions 14 and perpendicular to the longitudinal direction of the strap hinge 17. When the hoop-handle is tilted downwards (FIGS. 2, 3), the strap hinge 17 is bent off downwards, the curvature being slight.

If the hoop-handle 13 is tilted up and the receptacle lifted by it (FIG. 4), then the strap hinge 17 comes to bear against the outer side of the bow 16 and of the adjoining vertical bar 15*b*, which outer side forms a strip-shaped supporting face. Here too, the curvature remains relatively slight. Not only does this prevent material fatigue, the strap can also be relatively thick, enabling it to withstand high tensile stresses. As a result of the described configuration of the carrying extension 14, those forces which act, via the said carrying extension, upon the strap hinge 17 when the receptacle is carried are not wholly concentrated upon the attachment point, but are partly transferred by friction via the bar 15*b* and the bow 16, so that the attachment point is somewhat relieved of stress.

At a slight distance from the bar 15*b*, a retaining cam 18 is formed onto the reinforcing ring 7, which retaining cam comprises a retaining fin 19, which runs parallel to the bar 15*b* and projects less far outwards than the carrying extension 14. On the side facing away from the carrying extension 14, the retaining fin 19 is supported by a horizontal ramp 20, which emanates, likewise like a fin, from the lower end of the said retaining fin. When the hoop-handle 13 is erect, the strap hinge 117 lies between the bar 15*b* and the retaining fin 19, so that the said hoop-handle is retained in an at least approximately perpendicular position and can thereby always easily be grasped. When tilted up into the vertical position, the ramp 20 ensures that the strap hinge 17 is pulled over the retaining fin 19 into the described position and does not get caught on the retaining fin 19.

The hoop-handle 13 can, of course, be fastened in the same way to a reinforcing ring connected fixedly to the vessel or even directly to the side wall of the vessel. The fact that the hoop-handle attaches to a relatively stiff reinforcing ring has the advantage, however, that the fairly large forces which are brought to play via the hoop-handle are safely absorbed and do not result in critical deformations of the vessel.

Conversely, the reinforcing ring does not need to exhibit a hoop-handle. It can however be prepared for the suspension of a separate hoop-handle, as is shown with reference to the second and third embodiments.

For better securement to the bucket 1, the stabilizing ring 10 bears (FIGS. 5–7) four spacers 21, which are distributed uniformly over its periphery and respectively comprise two connected parallel ribs, protruding radially outwards, and rise upwards. When the reinforcing ring 7 is mounted, these spacers abut against the underside of the lip 4, so that the reinforcing ring is positioned somewhat beneath the upper rim of the side wall 3.

The collar 9 is provided on its inner side with flat projections 22 distributed, just like the spacers 21, over the periphery of the reinforcing ring 7, which projections engage in the indentation 6 and form with the said indentation a snap fastening which retains the reinforcing ring 7 on the bucket 1. At two diametrically opposing points, the reinforcing ring 7 exhibits, along the outer face of the side wall 3, downwardly protruding stacking fins 23, by means of which, when the buckets are tucked one inside the other, the reinforcing ring 7 is supported on the lip of the bucket below.

A downwardly protruding rim 24 on the lid 8 embraces the lip 4 and reaches with a circumferential indentation 25 below the rim of the said lip, so that the lid 8 is secured by a snap fastening. Connected to the rim 24, by a tear-off band 26 which is limited at top and bottom by thin-points, are securing hooks 27, which engage in securing openings 28 in the stabilizing ring 10 of the reinforcing ring 7. The lid 8 can only be removed once the tear-off band 26 has previously been torn away by means of a tear-off ring 29 and the connection between the securing hooks 27 and the remaining part of the lid 8 has thus been released. The unnoticed removal of material from the bucket 1 is therefore not possible. Even after the tear-off band 26 has been removed, the lid 8 is retained on the bucket 1 by the aforementioned snap fastening. Thanks to a circumferential seal 30 in a groove of the lid 8, which seal presses against the lip 4, the bucket 1 is tightly sealed by the lid 8.

Figure 10:
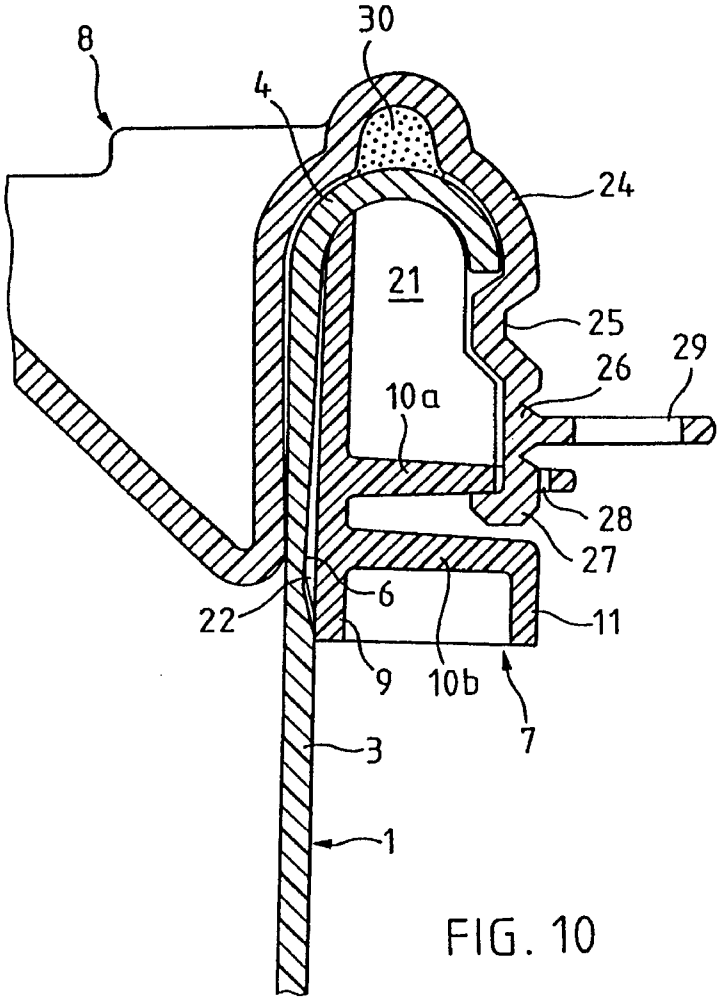
FIG. 10 shows a section through the upper rim of the side wall of the receptacle, exhibiting the reinforcing ring according to the second embodiment and the lid.
Figure 8:
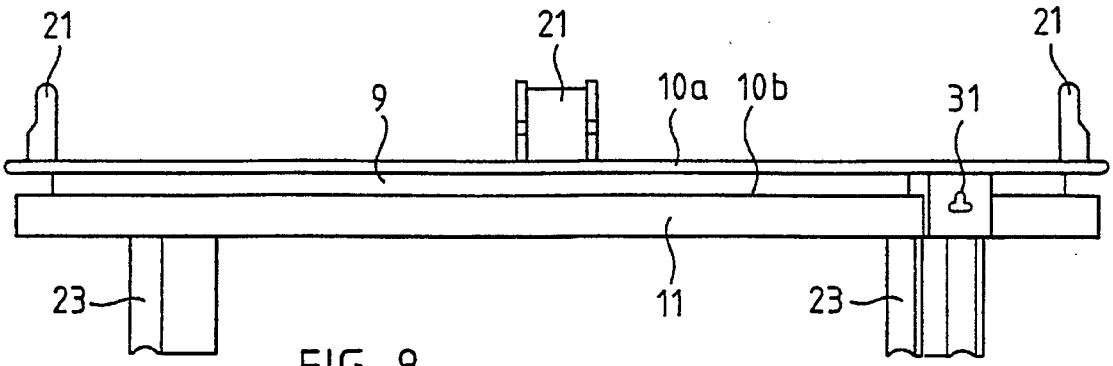
FIG. 8 shows a side view of a reinforcing ring according to a second embodiment.
Figure 9:
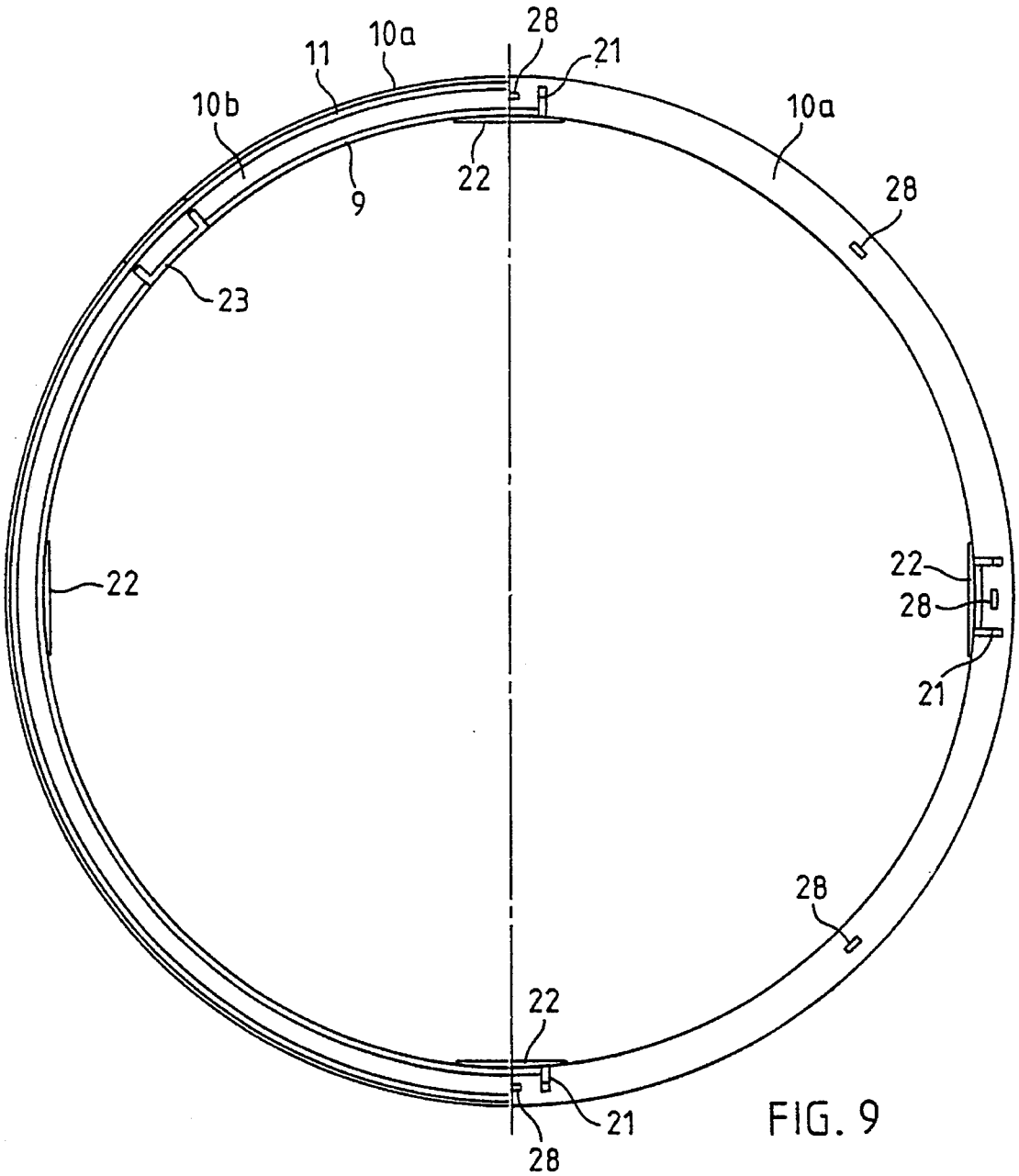
FIG. 9 shows a projection onto the reinforcing ring according to the second embodiment, on the left from below, on the right from above.

Whilst the first embodiment of a reinforcing ring was developed particularly with regard to high mechanical stresses, the second embodiment represented in FIGS. 8–10 is suitable for medium stresses. The reinforcing ring 7 exhibits two circular stabilizing rings 10*a,b* formed onto a collar 9, which, when the reinforcing ring is mounted, bears against the outer side of the bucket 1, the lower of the said stabilizing rings bearing a downwardly pointing apron 11 adjoining its outer rim. Reinforcing ribs, on the other hand, are not provided. Above the stacking fins 23, there are made in the apron 11 hoop-handle openings 31, in which ends of a hoop-handle can be introduced, which ends are provided with fastening cams. Otherwise, the second embodiment corresponds broadly to the first embodiment which has already been extensively described.

Figure 11:
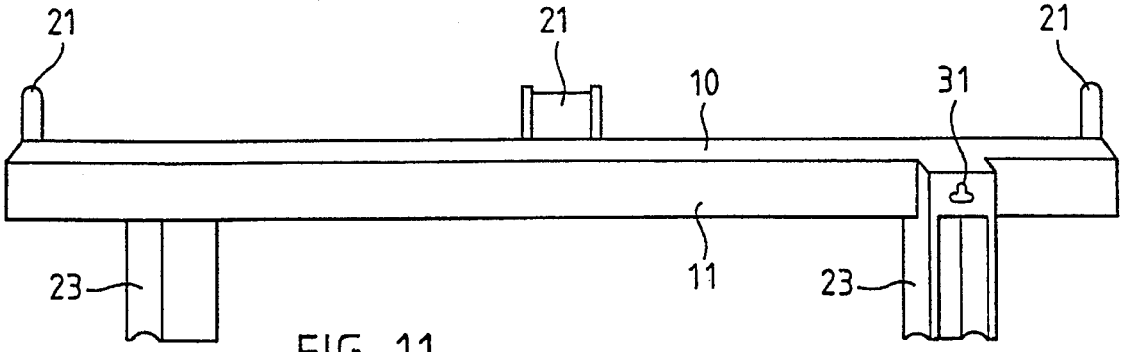
FIG. 11 shows a side view of a reinforcing ring according to a third embodiment.
Figure 12:
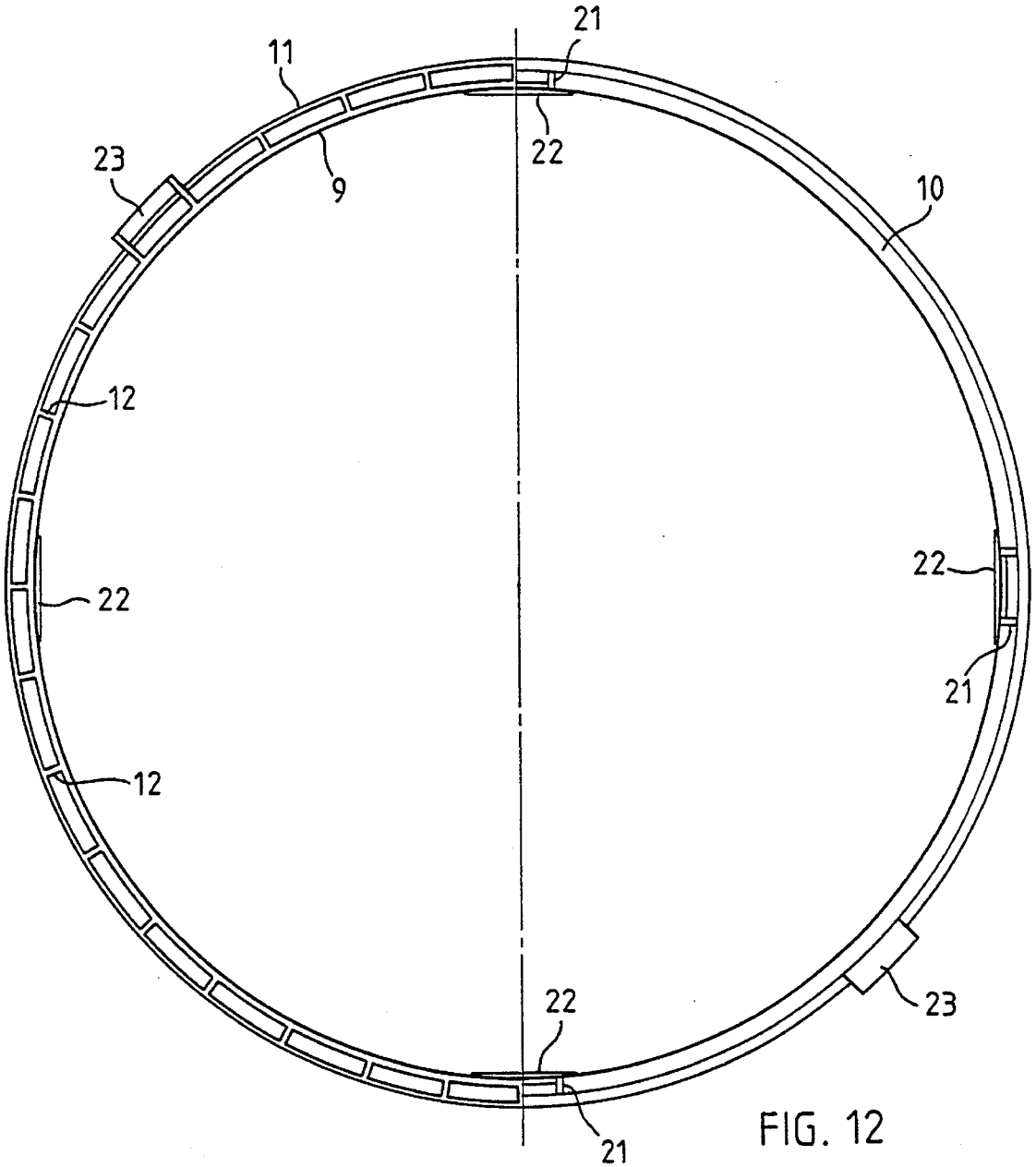
FIG. 12 shows a projection onto the reinforcing ring according to the third embodiment, on the left from below, on the right from above.
Figure 13:
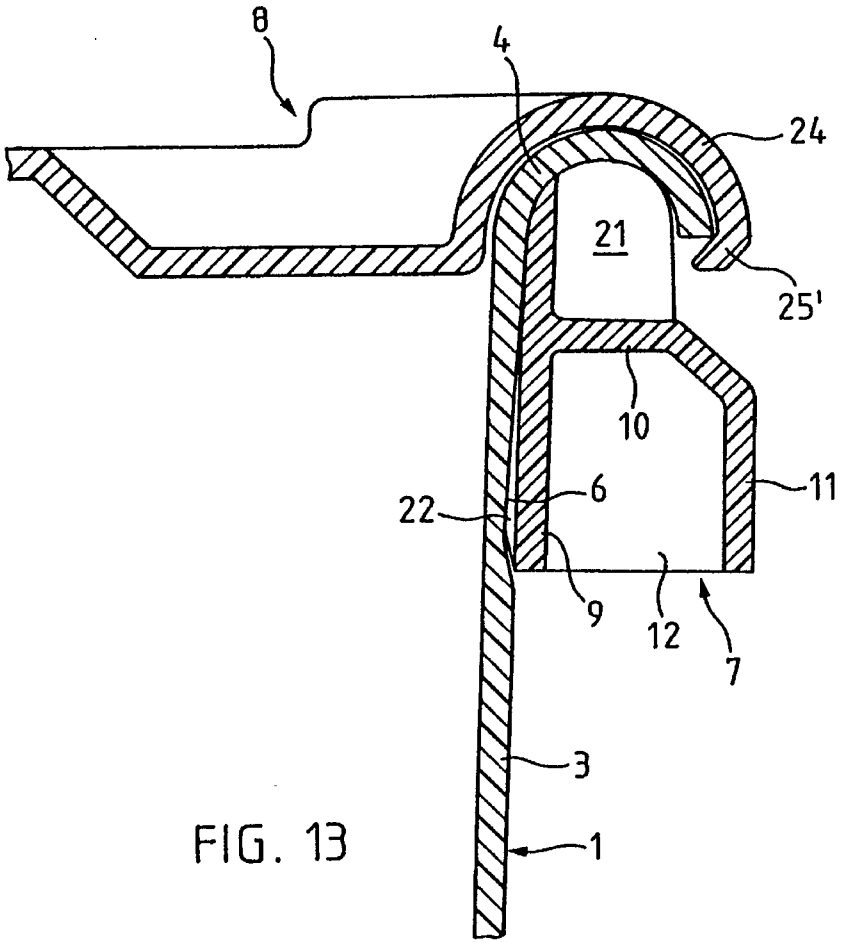
FIG. 13 shows a section through the upper rim of the side wall of the receptacle, exhibiting the reinforcing ring according to the third embodiment and the lid.

For lighter to medium mechanical stresses, a third embodiment of a reinforcing ring is envisaged, as represented in FIGS. 11–13. This likewise exhibits a collar 9, for making contact with the outer side of the side wall 3, and an apron 11 concentric thereto, which are joined together by a narrow stabilizing ring 10, the outer part of which slopes down in the outward direction, and by regularly spaced radial reinforcing ribs 12, and form a stable double ring. Otherwise, the embodiment corresponds broadly to the second embodiment, but for the fact that the lid 8, configured so as to be lighter, is not secured, but is retained solely by a snap connection which takes effect between an indentation 25' on the lid rim and the rim of the lip 4.

In all three embodiments, the reinforcing ring 7 can be slid onto the bucket 1 from below and, once the projections 22 have snapped into the indentation 6, is secured. Since the indentation 6 is circumferential in configuration, the angular position of the reinforcing ring 7 does not need to be monitored. The reinforcing ring 7 not only stabilizes the upper marginal region of the side wall 3 of the bucket and hence, inter alia, the seat of the lid 8, it also substantially absorbs those forces which are brought to play, for instance, via a hoop-handle or via the stacking fins 23. It can be configured and dimensioned according to the anticipated mechanical stresses and in particular—quite irrespective of the material of the bucket—can be made from the best-suited material. In the case of very high anticipated mechanical stresses, it can consist of a high-grade polymer such as polypropylene or even, where appropriate, also inclusive of the hoop-handle, of metal, e.g. sheet-metal, wire or both, whilst the less stress-subjected bucket 1 is injection-moulded out of reclaimed material. Conversely, where the anticipated stress is low, the reinforcing ring 7 can be made from reclaimed material, irrespective of whether that is also admissible for the bucket 1 with regard to the intended use. Generally speaking, different buckets can be freely combined with different reinforcing rings, provided that the measurements in the contact region tally.

For the reinforcing ring there are, apart from the choice of material, a large number of varying design options. Thus the collar, for instance, can be configured in a corrugated and resilient form or else the reinforcing ring can touch the bucket only in places, for instance by means of inwardly protruding contact pieces. Instead of being snapped on as described, the said reinforcing ring, as it is slid on, can easily be clamped to an upwardly widening bucket, which would be aided and abetted by any resiliently configured collar provided.

Since, in order to spare resources and curb the flood of waste, it is very desirable that buckets should be used several times over, tests have recently been conducted on coating buckets externally, internally or both externally and internally with a thin plastics film. In the first instance, the inscriptions which are at least necessary in retailing do not need to be applied to the bucket itself, which both simplifies its production and allows its multiple use for different purposes—for instance, a first use in the foodstuffs field and re-use in a less sensitive area, since the characterizing outer casing can be easily exchanged. In the second instance, the bucket is protected from direct contact with the filling material, so that, once the inner casing is removed, it is available for further use without having to be cleaned internally. By using a casing which fully encloses the bucket, both advantages are obtained.

In the case of buckets having a formed-on reinforcing ring, the fitting of an inner casing is difficult, that of an outer casing only possible if at all beneath the reinforcing ring, since the reinforcing ring and parts fastened thereto, e.g. a hoop-handle, are in the way. By contrast, the receptacle according to the invention presents no difficulties in this regard, since the casing can be applied to the bucket and the reinforcing ring then put on. A specific advantage can even be obtained by the reinforcing ring being used to retain the casing on the bucket and to protect, in particular, the upper rim of the said casing, where the outer casing is easily prone to initial tearing.

Figure 14:
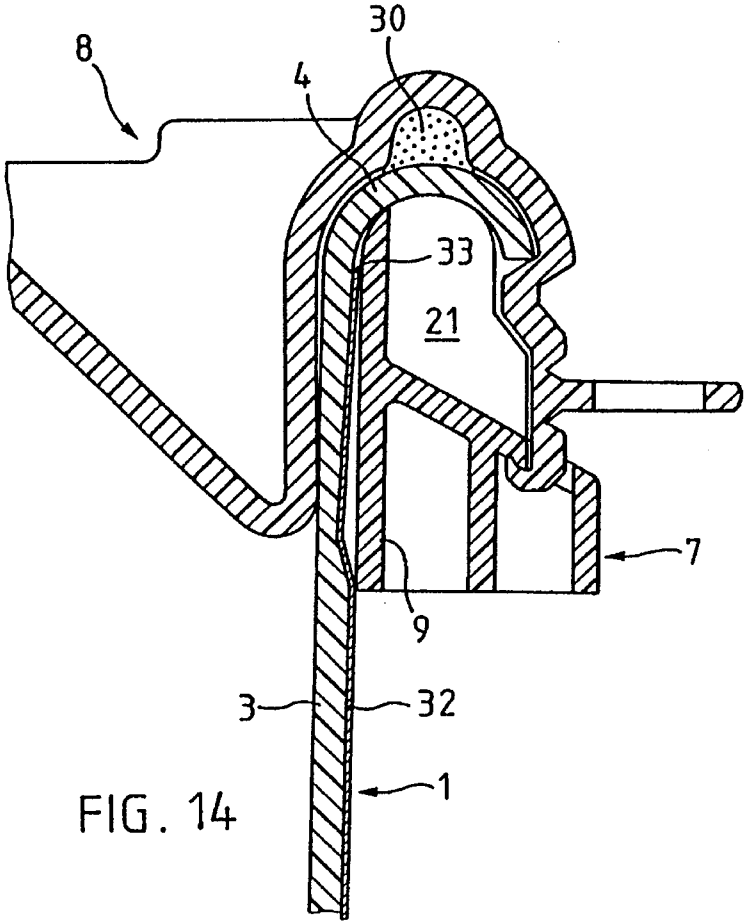
FIG. 14 shows a section according to FIG. 7, in which the outer face of the vessel is covered with a plastics-film outer casing.
Figure 16:
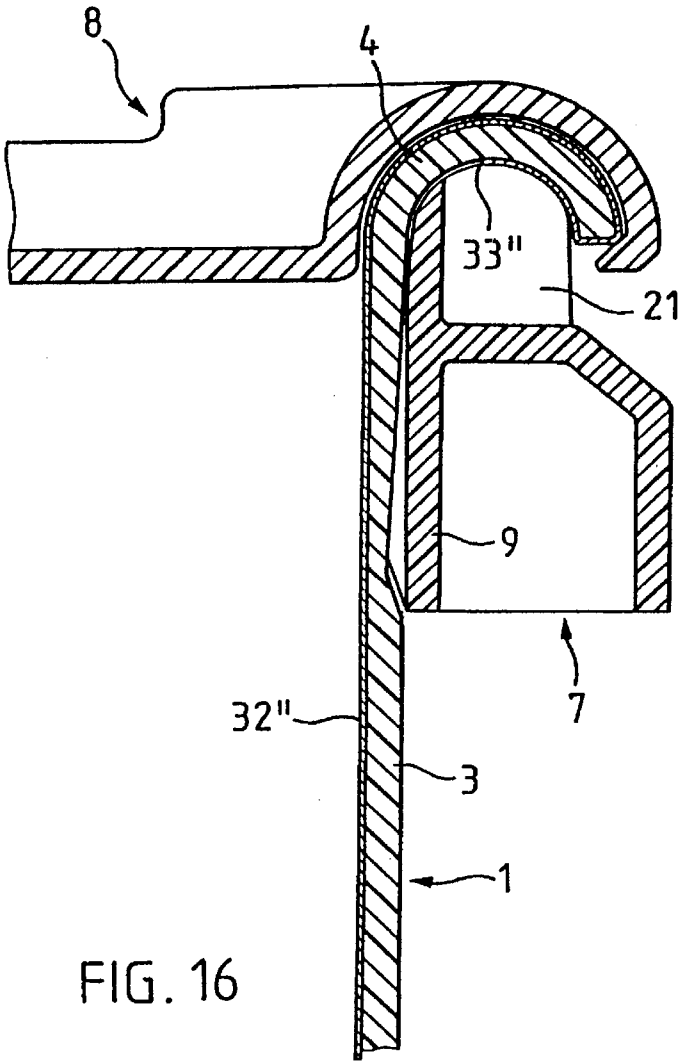
FIG. 16 shows a section according to FIG. 13, in which the inner face of the vessel is covered with a plastics-film inner casing.
Figure 15:
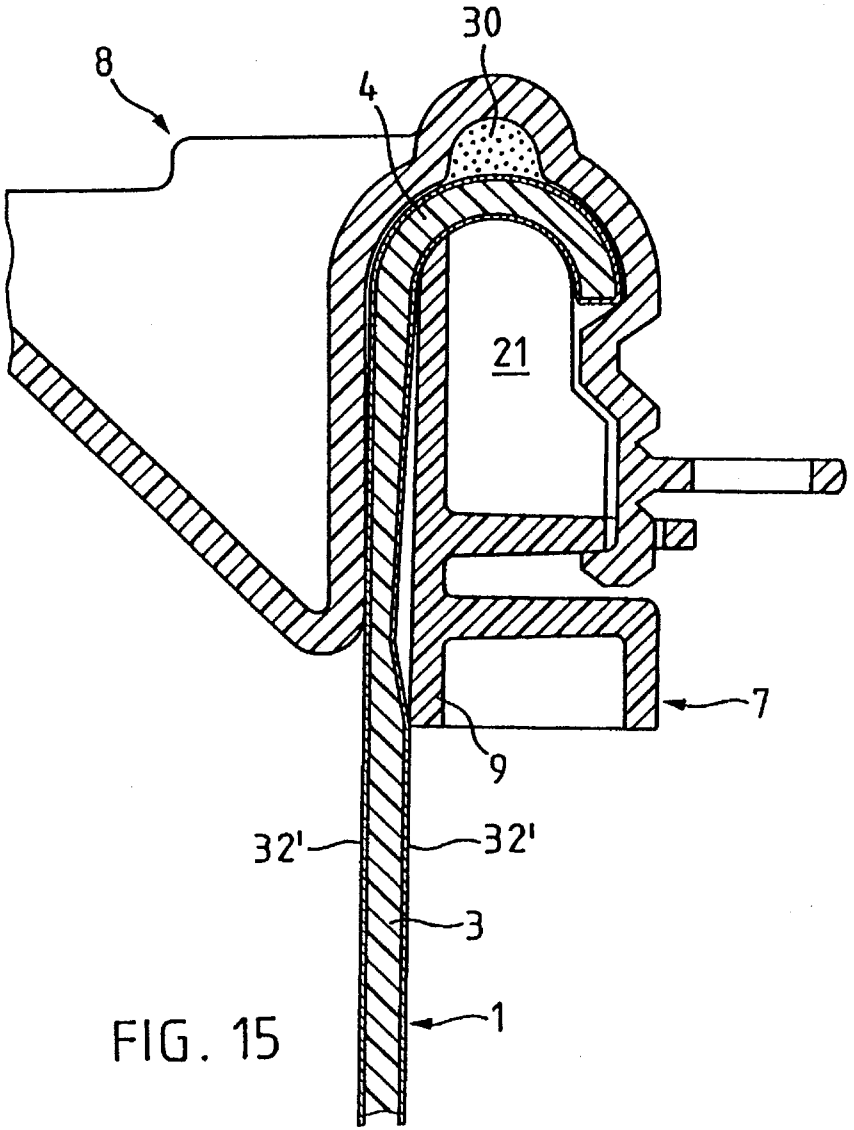
FIG. 15 shows a section according to FIG. 10, in which the vessel is covered internally and externally with a plastics-film casing.

Thus FIG. 14 illustrates a bucket 1 provided with an outer casing 32, the rim 33 of which runs just beneath the lip 4. The reinforcing ring 7 is slid over the outer casing 37 so that the said outer casing is clamped in place between the outer side of the side wall 3 and the inner side of the collar 9 and is reliably retained. Similarly, in FIG. 15, a casing 32' is shown which completely encloses the bucket 1, which casing is likewise clamped by the collar 9 and, moreover, by the spacers 21 to the outer side of the side wall 3 and, additionally, by the lid 8 to the lip 4 and the upper part of the inner side of the side wall 3. The seal 30 is just as effective in this case as in a bucket without a casing. Finally, FIG. 16 shows the bucket 1 having an inner casing 32" which is drawn up to the underside of the lip 4, so that the marginal strip lying between the rim of the said lip and the rim 33" of the inner casing 32" is clamped between the spacers 21 and the underside of the lip 4.

I claim:

1. A receptacle comprising:

a vessel made of plastic material and having a base and a circumferential sidewall;

a single hoop handle integrally connected onto said sidewall at respective attachment points two carrying extensions which are externally provided on said sidewall and each comprise two vertical bars, so as to be pivotable about a swivel axis connecting said carrying extensions, by respective strap hinges, each of which is configured as a band-like flexible intermediate piece and is connected at one end thereof to a respective end of said hoop handle and connected at an opposite end tangentially to a bow which connects the respective two vertical bars of each respective carrying extension, so that the two said carrying extensions are aligned on an axis which is substantially parallel to said swivel axis, both of said vertical bars of each said carrying extension being located on a same side of said swivel axis.

2. Receptacle according to claim 1, characterized in that the strap hinge (17), at each said attachment point, runs approximately horizontally.

3. Receptacle according to claim 1, characterized in that the carrying extension (14) exhibits a strip-shaped supporting face, which, at each said attachment point of the strap hinge (17), runs approximately parallel to the latter and, further on, is bent off upwards.

4. Receptacle according to claim 3, characterized in that the carrying extension (14) is configured as a stay which is bent into a U-shape and to whose underside there attaches the strap hinge (17).

5. Receptacle according to claim 1, characterized in that on the outer side of the receptacle, beside the carrying extension (14), a retaining cam (18) is fitted in such a way that the hoop-handle (13) is held between the carrying extension (14) and the retaining cam (18) in an approximately upright position.

6. Receptacle according to claim 5, characterized in that the retaining cam (18) forms a ramp (20) which rises outwards, in the peripheral direction, up towards the carrying extension (14).

7. Receptacle according to claim 1, characterized in that the side wall (3) has an approximately perpendicular or slightly outward-leaning inclination and the receptacle comprises a reinforcing ring (7), which, surrounding the side wall (3), is fitted removably to the vessel, and in that the hoop-handle (13) is formed onto the reinforcing ring (7).

8. Receptacle according to claim 7, characterized in that the reinforcing ring (7) is fixed or clamped to the vessel by a snap fastening.

9. Receptacle according to claim 7, characterized in that the reinforcing ring (7) comprises a circumferential collar (9), which bears at least in places against the outer face of the side wall (3).

10. Receptacle according to claim 9, characterized in that the collar (9) exhibits, on its inner side, a plurality of flat projections (22), which engage in a circumferential indentation (6) on the outer wall of the vessel.

11. Receptacle according to claim 9, characterized in that the collar (9) bears at least one outwardly protruding, circumferential stabilizing ring (10; 10*a*, 10*b*).

12. Receptacle according to claim 11, characterized in that the outer rim of the at least one stabilizing ring (10; 10*b*) is adjoined by a downwardly pointing, circumferential apron (11).

13. Receptacle according to claim 7, characterized in that the upper rim of the side wall (3) exhibits a circumferential, outwardly pointing lip (4) and the reinforcing ring (7) is disposed beneath the lip (4) and abuts against the said lip.

14. Receptacle according to claim 13, characterized in that the reinforcing ring (7) exhibits a plurality of upwardly pointing spacers (21) distributed over its periphery, which spacers bear respectively, with their upper end, against the underside of the lip (4).

15. Receptacle according to claim 7, characterized in that the reinforcing ring (7) bears a plurality of downwardly projecting stacking fins (23) distributed over its periphery.

16. Receptacle according to claim 7, characterized in that at least the outer side of the side wall (3) of the vessel is covered by a plastics-film outer casing (32), which is situated, at its upper part, within the reinforcing ring (7).

17. Receptacle according to claim 7, characterized in that at least the inner face of the vessel is covered by a plastics inner casing (32"), which extends beyond its rim onto the outer side of the side wall (3) and is clamped there between the said side wall and the reinforcing ring (7).

18. Receptacle according to claim 7, characterized in that it is provided with a lid (8), which reaches over the upper rim of the side wall (3).

19. Receptacle according to claim 18, characterized in that the lid (8) is secured on the receptacle by securing parts which engage with the reinforcing ring (7).

20. Receptacle according to claim 12, characterized in that the lid (8) is secured on the receptable by securing parts which engage with the reinforcing ring (7), and the securing parts are configured as securing hooks (27), which engage in securing openings (28) in the at least one stabilizing ring (10).

21. Receptacle according to claim 19, characterized in that the securing parts are connected to the remaining part of the lid (8) by a circumferential tear-off band (26).

22. Receptacle according to claim 13, characterized in that it is provided with a lid (8), which reaches over the upper rim of the side wall (3), and the lid (8) reaches beneath the lip (4) with a circumferential catch-lock, so that it is secured on the receptacle by a snap-fastening.

* * * * *